US005403000A

United States Patent [19]

Woosley

[11] Patent Number: 5,403,000

[45] Date of Patent: Apr. 4, 1995

[54] ILLUMINATED GAME BALL APPARATUS

[76] Inventor: John Woosley, 1639 - 11th St., Santa Monica, Calif. 90404

[21] Appl. No.: 252,924

[22] Filed: Jun. 2, 1994

Related U.S. Application Data

[62] Division of Ser. No. 22,070, Feb. 24, 1993, abandoned.

[51] Int. Cl.[6] ..... A63B 63/08

[52] U.S. Cl. ..... 273/1.5 R; 273/DIG. 24; 273/29 A

[58] Field of Search ..... 273/1.5 R, 1.5 A, 29 R, 273/29 A, 30, DIG. 24, 407, 411, 424

[56] References Cited

U.S. PATENT DOCUMENTS

| | | | |
|---|---|---|---|
| 3,971,560 | 7/1976 | Panosh | 273/30 |
| 4,231,572 | 11/1980 | Thornton | 273/29 A |
| 4,696,471 | 9/1987 | McGrath et al. | 273/29 A |
| 4,846,475 | 7/1989 | Newcomb et al. | 273/128 R |
| 4,979,751 | 12/1990 | Sullivan, III | 273/DIG. 24 |
| 4,984,787 | 1/1991 | Neshit et al. | 273/1.5 R |
| 4,991,837 | 2/1991 | Deal | 273/1.5 R |
| 5,083,799 | 1/1992 | Thill | 273/424 |
| 5,192,080 | 3/1993 | Duncan | 273/DIG. 24 |
| 5,305,998 | 4/1994 | Nesbit et al. | 273/1.5 R |

*Primary Examiner*—K. Miller
*Assistant Examiner*—Steven B. Wong
*Attorney, Agent, or Firm*—Albert M. Herzig

[57] ABSTRACT

A game ball is disclosed herein having an inflatable bladder or shell with selected portions thereof reduced in thickness to provide transparent or translucent patterns separated by increased thickness to provide opaque portions. The interior of the ball is occupied by a breakable liquid illumination device held in a removable housing of transparent or translucent material for conveying illumination from the device to the selected portions of the ball thereby transmitting the illumination exteriorly of the ball for visual observation. The apparatus may include ancillary components, such as hoops or nets, which may support an elongated illumination device so that the visual glow from both the ball and component may be correlated during the play of a game.

3 Claims, 2 Drawing Sheets

ILLUMINATED GAME BALL APPARATUS

This application is a divisional of Ser. No. 08/022070, filed Feb. 24, 1993, now abandoned.

BACKGROUND OF THE INVENTION

1. Field of the Invention

The present invention relates to the field of games and amusement devices, and more particularly to a novel illuminated ball game apparatus which includes a ball having means for illuminating selected portions of its exterior so that it may be visually observed during a course of play and for illuminating ancillary components which are used in connection with the game, such as hoops and nets.

2. Brief Description of the Prior Art

In the past, it has been the conventional practice to employ a ball during the course of the game which has a hide or bladder that is readily inflatable to a desired aerodynamic shape. During the course of play, the ball is handled and observed by the players so that a variety of ball-handling techniques can be performed by the players according to the rules of play. Also, when such game elements as hoops and nets are involved, such as in the play of basketball or in the game of tennis, such components are used in connection with these techniques, both the ball and the components are visually observed and, therefore, during daylight hours or in well lighted areas, the players have no difficulty in making visual observation of the ball or the components.

However, problems and difficulties have been encountered when playing in dimly lighted areas or during twilight or other times and areas of reduced lighting. In order to make a playing area safe under such conditions, expensive and complicated night lights are sometimes placed about a field or course which illuminate the entire area on which the game is being played. However, such lights can be a hindrance because of glare and of a direct shining of the light into the eyes of the player. Therefore, it would appear that means are needed to more readily illuminate the playing ball and any components of the game so that the players can readily continue a game into twilight and darkness in safety.

Therefore, a long-standing need has existed to provide a novel means of illuminating a playing ball as well as other apparatus used in connection with a particular game so that the players can readily identify the ball and such apparatus during the course of play. Such illumination will greatly aid the players in ball handling techniques and procedures.

SUMMARY OF THE INVENTION

Accordingly, the above problems and difficulties are overcome by the present invention which provides a novel game ball and ancillary apparatus which includes illumination means whereby the players of the game can readily identify and observe a ball and the apparatus during hours of reduced light or when the playing court is dimly lit or not lit at all. The game ball includes a shell having selected portions composed of a translucent or transparent material through which light from an illumination source within the interior of the ball may be transmitted exteriorly of the ball. The ball shell or hide further includes areas which are composed of an opaque material separating the translucent or transparent material into a predetermined pattern. The illumination means is carried in a transparent housing and includes a fitting for removably accepting the illumination means so that it may be extracted from the ball when it is intended to obtain illumination therefrom. In one form of the invention, the illumination means takes the form of liquid chemicals contained in separate breakable containers such that when broken, the mixture of the chemicals results in illumination. Such illumination means is also employed in an elongated manner for detachably connecting with apparatus such as the hoop of a basketball backboard or upper edge of a tennis or volleyball net.

Therefore, it is among the primary objects of the present invention to provide a novel illuminated ball and ancillary equipment so that players of the game can readily identify the ball and equipment which will enhance the play of the game.

Another object of the present invention is to provide a novel means of illuminating sports equipment, such as balls, nets, hoops or the like, which employs a breakable chemical component which immediately emits a glow which is transmitted from the game apparatus or equipment.

Another object of the present invention is to provide a novel illuminated ball whereby a chemical illumination means is removably placed in the interior of the ball and wherein selected areas of the ball permit a glow from the illumination means to be transmitted exteriorly through selected transparent or translucent portions thereof.

Still another object resides in a novel illuminated ball having a varying thickness of shell so as to provide selected areas of opaqueness and translucency so as to provide various degrees of illumination depending upon its thickness or other treatment which varies the intensity of the observed light.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
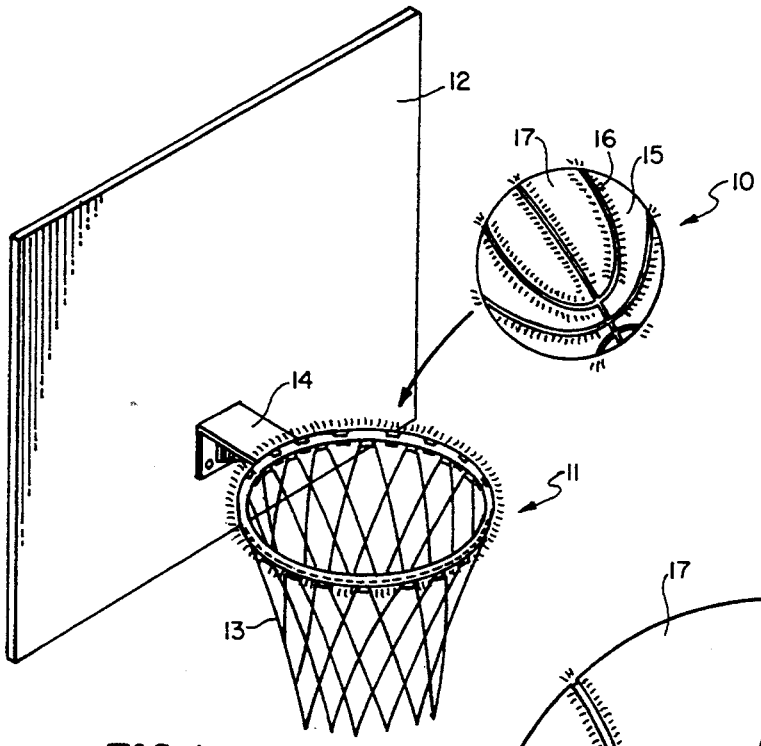
FIG. 1 is a front perspective view showing the game ball and hoop apparatus incorporating the present invention.

Referring to FIG. 1, the novel illuminated game ball is illustrated in the general direction of arrow 10 which incorporates the present invention. Also, it can be seen that the ball is used in combination with an illuminated component or apparatus taking the form of a hoop, which is illustrated in the general direction of arrow 11. The hoop is mounted on a backboard 12, such as for use in connection with the game of basketball and a conventional basket is downwardly depending from the hoop 11, as indicated by the netting 13. The hoop is secured to the backboard by means of a bracket 14 which outwardly projects from the backboard 12.

With respect to the illuminated game ball 10, it is to be noted that the ball includes a shell or hide 15 which is provided with selected areas, such as indicated by area 16, which are of reduced thickness so as to be translucent or transparent. Other portions are opaque and such an opaque portion is indicated by numeral 17 which is immediately adjacent to the thinned or reduced portion 16.

Figure 2:
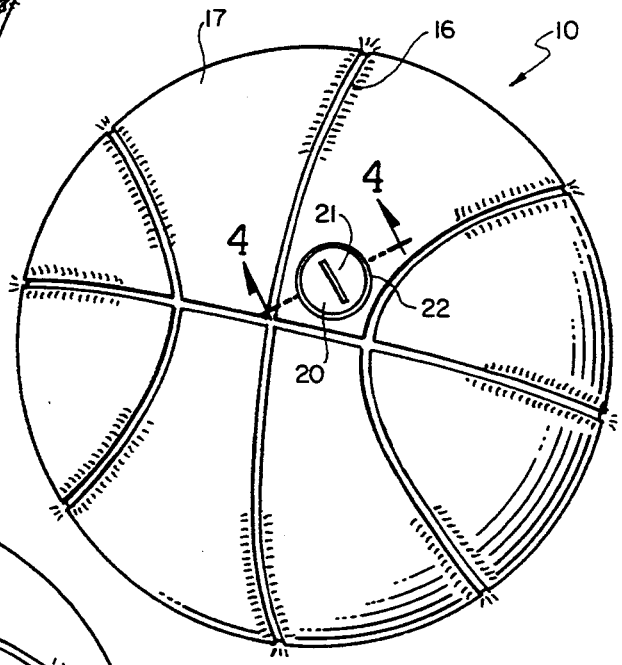
FIG. 2 is an enlarged elevational view of the game ball shown in FIG. 1.

Referring now in detail to FIG. 2, it can be seen that the opaque areas 17 are arranged so as to provide said translucent or transparent portions 16 into a variety of patterns. In the present illustration, the pattern of the portions 16 is selected so as to represent seams, which would normally appear in a basketball providing that the ball were constructed as requiring sewn seams. FIG. 2 also illustrates that an illuminating means 20 can be provided with a cap having a slot 21 therein for insertably receiving a removal tool, such as a coin, flat ended screwdriver or the like. The illumination means and its cap reside within a supporting structure 22 integrally formed with the material or shell of the ball 10.

Figure 3:
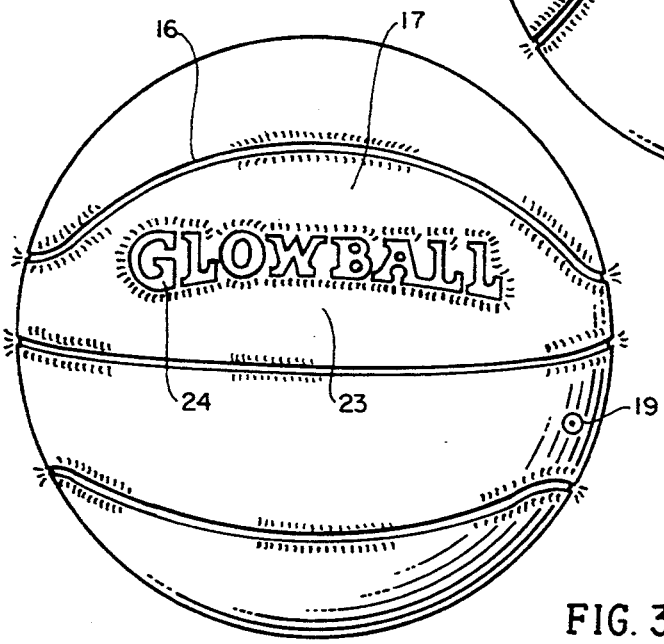
FIG. 3 is a view similar to the view of FIG. 2 showing the game ball with a specific message area.

In FIGS. 2 and 3, it can be seen that when the illuminating means has been actuated, the light from the illuminating means interiorly provided in the ball 10 will transmit through the selected portions 16 in the form of a "glow". Also, a portion of the opaque section or portion 17 can be provided with a message area, such as broadly identified by numeral 23, that may carry a selected message, graphic representation or other indicia. The message is defined by a reduction in the thickness of the material so as to provide additional selected portions as identified by numeral 24, which will permit the passage of light therethrough to generate the glow.

Figure 4:
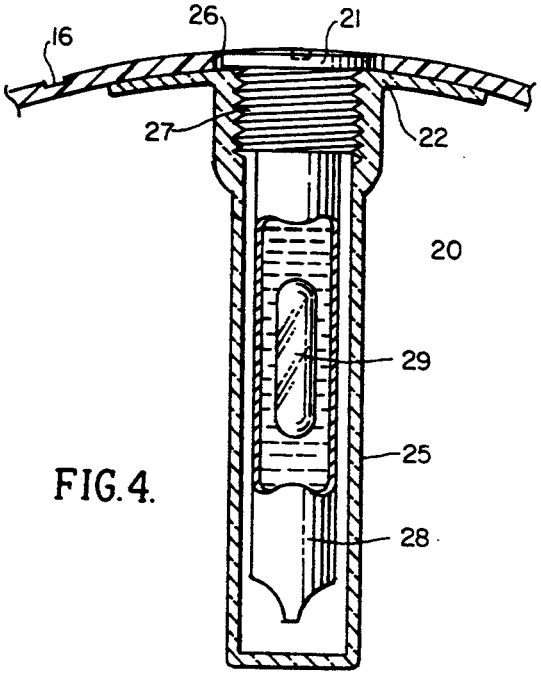
FIG. 4 is an enlarged sectional view of the illumination means taken in the direction of arrows 4—4 of FIG. 2.

Referring to FIG. 4, the illumination means 20 is illustrated within a housing 25 that is permanently attached to the shell or hide of the ball 10. It can be seen that the shell includes an opening 26 occupied by the grooved cap 21 which includes a peripheral shoulder bearing against the support 22. The support is secured to the inside of the shell so that the housing downwardly depends into the interior of the game ball. In order to make the illuminating means 20 removable from the housing 25, a threaded connection, identified by numeral 27, includes external and internal threads so that a threaded attachment is produced. Therefore, by twisting the cap 21, the illumination means may be removed from the housing 25. It can also be seen that the selected portion 16 is of reduced thickness in the shell so that illumination from the illuminating means 20 can pass through the translucent or transparent material composing housing 25 and transmitted through the shell externally of the ball.

Figure 5:
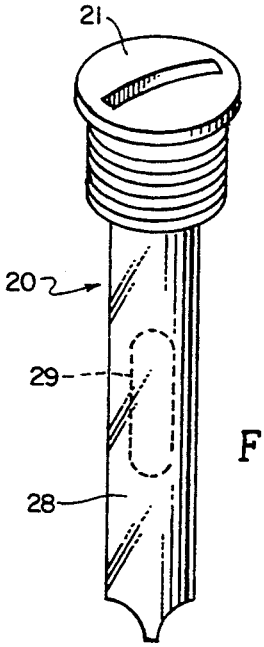
FIG. 5 is a perspective view showing the illumination means removed from the game ball.

It is also to be understood that the ball may be inflated by any suitable and conventional means, such as by providing a receptacle 19 for a needle attached to an inflation pump. Also, FIGS. 4 and 5 illustrate the illuminating means as being a conventional chemical illuminating agent contained within vial 28 and capsule 29 respectively. Upon removal of the vial/capsule from the housing, the capsule 29 may be broken so that the chemical ingredient therein mixes thoroughly with the chemical ingredient within vial 28. Such mixture causes illumination for a given period of time. Such an illuminating means is conventional and is readily disclosed in U.S. Pat. No. 4,313,843. FIG. 5 illustrates the illumination means as being removed and preparatory for the flexing of vial 28 so as to break the capsule 29.

Figure 6:
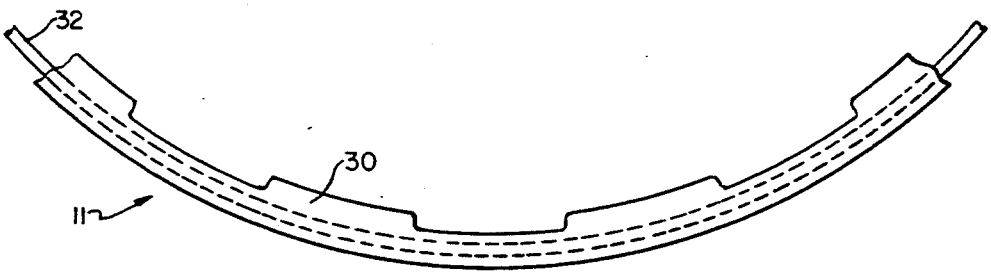
FIG. 6 is a top fragmentary view of the illuminated hoop shown, in FIG. 1.
Figure 7:
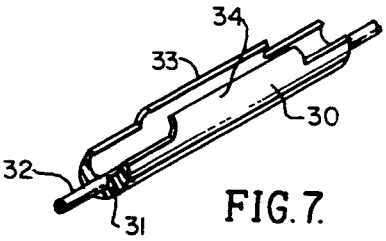
FIG. 7 is an enlarged fragmentary view, in sections, of the hoop shown in FIG. 6 illustrating the illumination device.

Referring now in detail to FIGS. 6 and 7, means are provided for illuminating the hoop 11 which include a holder 30 that includes retainer flanges, such as shown by numeral 31 in FIG. 7, that can readily grasp and hold an illuminating means such as described above onto the support 30. The illumination means in this instance is elongated and is of small diameter and contains a plurality of capsules or vials full of one of the necessary ingredients for producing the chemical illumination. The surrounding chemical constituting the second component to effect illumination is within the interior of device 32 and when the first chemical is released into contact with the second chemical, illumination will occur. Therefore, the ability to select when illumination is to commence is left to the user. It can also be seen in FIG. 7 that the support 30 includes retention elements 33 and 34 separated by a securement recess which may be spread to accommodate clamping onto a conventional hoop which is carried on the backboard 12.

Figure 8:
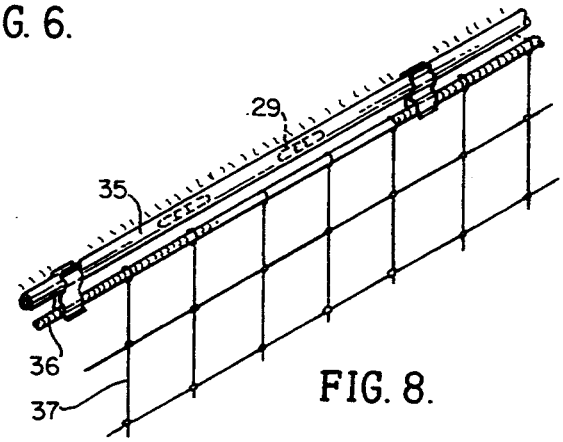
FIG. 8 is a perspective view of a tennis or volleyball net having illumination means carried along the top edge thereof in accordance with the present invention.
Figure 9:
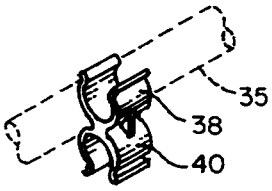
FIG. 9 is a perspective view of a support clamp used in removably supporting the illumination means shown in FIG. 8 onto the top edge of a net.

In a similar fashion, an illumination means, as described previously, is indicated by numeral 35 in FIGS. 8 and 9 and the device is held onto the top cord or cable 36 of a tennis or volleyball net 37. In FIG. 9, a suitable clip is illustrated having retainers 38 and 40 respectively which may be releasably clamped onto the device 35 and the cable 36 at the will of the user.

In view of the foregoing, it can be seen that the illuminated game ball and apparatus of the present invention permits players to engage in a game when the play area is not adequately illuminated or lit. In addition, a variety of patterns and message areas can be carried on the game ball that may present information or graphic representations in the form of designs, patterns or indicia. Furthermore, the illumination means is carried interiorly of the skin player when it is desired to activate the illumination means. After actuation, the means is replaced into the housing 25.

The illumination means takes the form of a chemiluminescent system to constitute a light source. The chemiluminescent light may be obtained by reacting an oxalic-type compound of the group consisting of an oxalic-type ester with a hydroperoxide compound in the presence of a solvent and chloro, fluoro or lower alkyl bis phenylethynyl-substituted aromatic compound as a fluorester. Such a light is described in U.S. Pat. Nos. 3,888,786 and 3,775,336.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Illuminated game apparatus comprising:

game equipment having an interior and an exterior;

illumination means carried on the interior of said game equipment;

means carried on said illumination means for selectively generating illumination;

means for removably mounting said illumination means on said game equipment; and said game equipment mounting means is an elongated support composed of light transmitting material having a receptacle in which said illumination means is retained and a securement recess for releasably mounting said support onto athletic game devices.

2. Illuminated sports equipment comprising:

a holder;

a pair of retainers disposed on said holder;

chemiluminescent means detachably carried by one retainer of said pair of retainers;

athletic equipment detachably mounted on the other retainer of said pair of retainers;

said chemiluminescent means employing fluorescers to provide a light source.

3. The invention as defined in claim 2 wherein:

said retainers are joined together and each retainer constitutes a spring clip.

* * * * *